US005926136A

United States Patent [19]

Ohtsuka et al.

[11] Patent Number: 5,926,136

[45] Date of Patent: Jul. 20, 1999

[54] ANTENNA APPARATUS

[75] Inventors: Masataka Ohtsuka; Yoshihiko Konishi; Makoto Matsunaga; Shintaro Nakahara, all of Tokyo, Japan

[73] Assignee: Mitsubishi Denki Kabushiki Kaisha, Tokyo, Japan

[21] Appl. No.: 08/852,599

[22] Filed: May 7, 1997

[30] Foreign Application Priority Data

May 14, 1996 [JP] Japan ..... 8-119395

[51] Int. Cl.[6] ..... H01Q 3/02

[52] U.S. Cl. ..... 343/700 MS; 343/873; 343/872

[58] Field of Search ..... 343/700 MS, 873, 343/872

[56] References Cited

U.S. PATENT DOCUMENTS

| | | | |
|---|---|---|---|
| 4,401,988 | 8/1983 | Kaloi | 343/700 MS |
| 4,623,893 | 11/1986 | Sabban | 343/700 MS |
| 5,155,493 | 10/1992 | Thursby et al. | 343/873 |
| 5,187,490 | 2/1993 | Ohta et al. | 343/700 MS |
| 5,315,753 | 5/1994 | Jensen et al. . | |
| 5,438,697 | 8/1995 | Fowler et al. . | |
| 5,646,633 | 7/1997 | Dahlberg | 343/700 MS |

*Primary Examiner*—Michael Tokar
*Assistant Examiner*—Daniel D. Chang

[57] ABSTRACT

In an antenna apparatus in which n dielectric layers with $\epsilon_{r1}-\epsilon_{rn}$ in dielectric constants are respectively stacked between a ground plate and a major radiating conductor, the thickness $t_1-t_n$ of the dielectric layers are determined so as to satisfy substantially the following equations:

$$(t_1+t_2+\ldots+t_n)/(t_1/\epsilon_{r1}+t_2/\epsilon_{r2}+\ldots+t_n/\epsilon_{rn})=\epsilon_{reff}, \text{ and}$$

$$t_1+t_2+\ldots t_n=t_{min}$$

with respect to a dielectric constant $\epsilon_{reff}$ of the antenna defined for a desired beam width, and the minimum value $t_{min}$ of the dielectric layers capable of ensuring a desired operation band and low reflection losses in this dielectric constant $\epsilon_{reff}$. Thus, the thinnest antenna structure which can ensure a desired radiation in directions of low elevation angles, and desired operation bands and low reflection losses can be made.

15 Claims, 5 Drawing Sheets

ANTENNA APPARATUS

BACKGROUND OF THE INVENTION

1. Field of the Invention

The present invention relates to an antenna apparatus which requires a radiation level to a direction of a low elevation angle, such as antenna apparatus employed for mobile phones utilizing satellites or the like.

2. Description of the Prior Art

FIGS. 8A–8C are schematic diagrams showing the construction of a conventional antenna apparatus disclosed in JP-A-2/219306. FIG. 8A is a sectional view of the antenna apparatus; FIG. 8B is a front view of a dielectric substrate 4 seen from side A in FIG. 8A; FIG. 8C is a front view of a dielectric substrate 3 seen from side B in FIG. 8A. In the drawings, numeral 1 designates a feed radiating element; numeral 2 designates a no-feed radiating element; numeral 3, 4 designate dielectric substrates; numeral 5 designates a ground plate; numeral 6 designates an air layer; numeral 7 designates a feeding line; numeral 8 designates a feeding connector. The air layer 6 is maintained by a structure such as spacer which keeps almost a constant interval between dielectric substrates 3, 4.

Next, the operation will be described.

The feed radiating element 1 is driven by radio waves which are fed through the feeding connector 8 and feeding line 7. The radio waves radiated from the driven feed radiating element 1 are electromagnetically coupled to the no-feed radiating element 2, thus driving the no-feed radiating element 2. The driven no-feed radiating element 2 radiates, spatially, the radio waves.

In such a conventional antenna apparatus, thickness dimensions $t_{c1}$, $t_{c2}$ shown in FIGS. 8A–8C are determined based on operation bands and reflection losses required for the antenna apparatus. Generally, when the upper limit of a desired reflection loss is determined, the operation band can be widened by extending the interval $t_{c1}$ between the ground plate 5 and feed radiating element 1, or the interval $t_{c1}+t_{c2}$ between the ground plate 5 and no-feed radiating element 2. For this reason, in the conventional antenna apparatus, many antennas are manufactured based on the thinnest dimension within the limits of achieving desired operation band and low reflection loss.

In addition, the smaller the dielectric constant inside the antenna, the smaller the quality factor Q of the antenna. Accordingly, a desired operation band can be achieved by a thinner thickness of the antenna, and also a larger design of the radiating element radiates intensively in a front direction of the antenna. For this reason, the following examples are frequently conducted: a dielectric formed inside the antenna such as the dielectric substrate 3 is made by a material with low dielectric constant such as foam material; constituted such that a ratio of the thickness $t_{c1}$ of the dielectric substrate 3 to the thickness $t_{c2}$ of the air layer 6 is enlarged.

SUMMARY OF THE INVENTION

Since the conventional antenna apparatus is constituted as described above, it takes only the operation band and radiation level in the front direction into consideration in ordinary design, thereby having a problem not capable of achieving a desired radiation level in directions of low elevation angles. On the other hand, in the antenna apparatus requiring intensive radiation in a direction of low elevation angles, not in a front direction such as automobile mounting antenna apparatus in vehicle satellite communication, however, even if a desired radiation level is achieved in directions of low elevation angle by a larger dielectric constant inside the antenna apparatus, and a smaller radiating element, the antenna factor Q is larger and the operation band is narrower. Consequently, the operation band has to be ensured by a thicker antenna apparatus. In this case, there is a problem in which the antenna apparatus has a greater thickness than need be.

The present invention has been made to overcome the above problems, and has an object to provide the thinnest antenna apparatus which can ensure a desired radiation level in directions of low elevation angle, and desired operation bands and low reflection losses.

In addition, another object of the present invention is to provide an antenna apparatus with lighter weight, an antenna apparatus with higher thickness precision of the structure, and a lower-cost antenna apparatus.

To attain the above objects, according to a first aspect of the present invention, there is provided an antenna apparatus in which n dielectric layers having $t_i$–$t_n$ in thickness, and $\epsilon_{r1}$–$\epsilon_{rn}$ in dielectric constant are respectively stacked between a major radiating conductor and a ground plate in turn from this ground plate side, the thicknesses $t_1$–$t_n$ of the n dielectric layers being determined so as to satisfy substantially the following equation with respect to a dielectric constant $\epsilon_{reff}$ of the antenna defined by a desired beam width:

$$(t_1+t_2+\ldots+t_n)/(t_1/\epsilon_{r1}+t_2/\epsilon_{r2}+\ldots+t_n/\epsilon_{rn})=\epsilon_{reff}$$

and satisfy substantially the following equation with respect to the minimum value $t_{min}$ of a thickness between a radiating conductor and a ground plate capable of ensuring a desired operation band and low reflection losses in said dielectric constant $\epsilon_{reff}$:

$$t_1+t_2+\ldots+t_n=t_{min}$$

According to a second aspect of this invention, it is preferable that the major radiating conductor is a feed radiating conductor which is fed, and that the thicknesses $t_1$–$t_n$ of the n dielectric layers are determined as described above.

According to a third aspect of this invention, the n dielectric layers may include an air layer.

According to a fourth aspect of this invention, there is an antenna apparatus comprising:

- a major radiating conductor formed on the n-th dielectric layer which is not fed;
- a feed radiating conductor, formed on a dielectric layer except the n-th layer, for driving the major radiating conductor; and
- a feeding circuit for feeding the feed radiating conductor.

According to a fifth aspect of this invention, the antenna apparatus may be constituted as follows: the feed radiating conductor and feeding circuit formed by use of a film substrate are disposed on a rigid dielectric layer; a buffer material is disposed on the film substrate; a rigid dielectric layer is disposed on the buffer material.

According to a sixth aspect of this invention, it is preferable that the rigid dielectric layer is made of fluorocarbon resin or polyphenylene oxide.

According to a seventh aspect of this invention, it is preferable that the buffer material is made of a foam resin.

According to an eighth aspect of this invention, there is an antenna apparatus such that a portion in contact with the buffer material of the rigid dielectric layer is left, and that the dielectric layer on the side of the major radiating conductor from the portion is removed except the perimeters of the major radiating conductor and feed radiating conductor.

According to a ninth aspect of this invention, there is an antenna apparatus such that all of part of the dielectric layers on the side of the major radiating conductor from the feed radiating conductor and feeding circuit are removed except the perimeters of the major radiating conductor and feed radiating conductor.

According to a tenth aspect of this invention, it may be constructed in such a manner that all or part of the dielectric layers are removed except the perimeter of the major radiating conductor.

According to an eleventh aspect of this invention, there is provided a thickness holding structure for keeping substantially constant the thickness of the dielectric layer with low rigidity arranged on any one of the dielectric layers except the n-th layer.

According to a twelfth aspect of this invention, it is preferable that the thickness holding structure is formed by use of a spacer that is intervened between a first dielectric layer and a third dielectric layer which are higher in rigidity than a second dielectric layer with low rigidity, and that is contained in the second dielectric layer.

According to a thirteenth aspect of this invention, it is preferable that the spacer is made of a material having a rigidity higher than that of the second dielectric layer.

According to a fourteenth aspect of this invention, the spacer is preferably constructed in such a manner that a caulking nut is intervened between the first and second dielectric layers and a ground plate meshes with a screw via an opening through the third dielectric layer from its top.

According to a fifteenth aspect of this invention, there is provided an antenna apparatus such that a rotary joint is connected to the feeding for feeding the major radiating conductor, and that the major radiating conductor is arranged to prevent the feeding circuit and the rotary joint from overlapping at the connection.

According to a sixteenth aspect of this invention, there is provided an antenna apparatus such that the rotary joint is connected to the feeding circuit for feeding the feed radiating conductor, and that the feed radiating conductor is arranged to prevent the feeding circuit and the rotary joint from overlapping at the connection.

BRIEF DESCRIPTION OF THE DRAWINGS

Further objects and advantages of the present invention can be more fully understood from the following detailed description taken in conjunction with the accompanying drawings, in which:

FIGS. 7A and 7B are longitudinal sectional views; FIG. 7B corresponds to sectional views along the line I—I line of FIG. 7A and the line II—II of FIG. 7C; FIG. 8A is a sectional view; FIG. 8B is a front view of the dielectric substrate 4 seen from side A in FIG. 8A; FIG. 8C is a front view of the dielectric substrate 3 seen from side B in FIG. 8A.

DETAILED DESCRIPTION OF THE PREFERRED EMBODIMENTS

Preferred embodiments of the present invention will now be described in detail with reference to the accompanying drawings.

Embodiment 1

Figure 1:
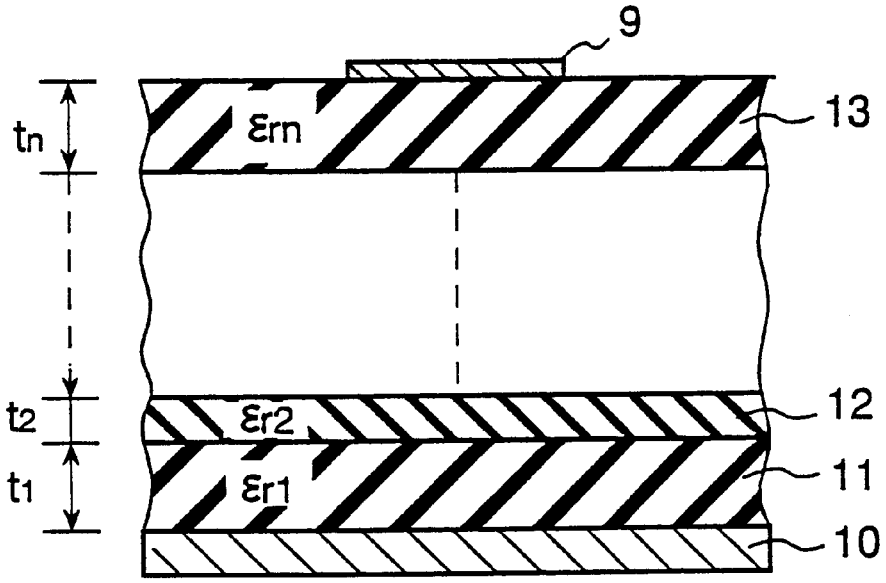
FIG. 1 is a sectional view showing the structure of an antenna apparatus according to Embodiment 1.

FIG. 1 is a sectional view showing the structure of an antenna apparatus according to the embodiment 1 of the present invention. In the drawing, numeral 9 designates a radiating element or a major radiating conductor which is fed. Both of feed and no-feed radiating conductors are considered to be applied to a major radiating material of the antenna apparatus. In the embodiment 1, a radiating element 9 as a major radiating conductor is described for a feed radiating conductor having feeding means such as feeding circuit as one example for convenience' sake of description. Numeral 10 designates a conductive plate or ground plate; numeral 11 designates a first dielectric layer; numeral 12 designates a second dielectric layer; numeral 13 designates a n-th dielectric layer. The dielectric layers are n layers in total, and stacked between the radiating element 9 and the conductive plate 10. The dielectric layers have $t_1, t_2, \ldots, t_n$ in thickness, and $\epsilon_{r1}, \epsilon_{r2}, \ldots, \epsilon_{rn}$ in dielectric constant. Note that the dielectric layers are secured by a method such as screwing or packing after stacked.

Next, the operation will be described.

The radiating element 9 is driven by electric waves fed through the feeding means such as feeding circuit. The driven radiating element 9 radiates radio waves in the air. In this case, in the antenna apparatus formed by the minimum thickness as described below, the radiation is conducted, which ensures a desired radiation level to a direction of low elevation angle, and desired reflective characteristic and operation band.

The thicknesses $t_1, t_2 \ldots, t_n$ of the dielectric layers in the antenna apparatus are defined in the following manner. The dielectric constant $\epsilon_{reff}$ of the antenna is first described. Typically, a dielectric constant of an antenna means such as a single dielectric layer is considered to be formed between the radiating element 9 and conductive ground plate 10. In a case where a plurality of dielectric layers are formed as shown in FIG. 1, when the plurality of dielectric layers are replaced by a single dielectric layer so as not to change the spacing between the radiating element 9 and conductive ground plate 10, the size of the radiating element 9, and the operation frequency of the radiating element 9, the dielectric constant $\epsilon_{reff}$ of the single dielectric layer is approximated by the following equation (1):

$$\epsilon_{reff}=(t_1+t_2+\ldots+t_n)/(t_1/\epsilon_{r1}+t_2/\epsilon_{r2}+\ldots+t_n/\epsilon_{rn}) \quad (1)$$

On the other hand, a radiating pattern of the radiating element 9 is defined by the dielectric constant $\epsilon_{reff}$ of the antenna and the configuration of the radiating element 9. Accordingly, when the configuration of the radiating element 9 is defined in advance, the dielectric constant $\epsilon_{reff}$ of the antenna is defined, which is required to obtain a desired beam width (beam spread) capable of ensuring a desired radiation level in directions of low elevation angles.

Next, the operation band and reflection loss of the radiating element 9 is considered. The operation band of the radiating element 9 in which VSWR, index of reflection loss, is not more than "s" is expressed by the following equation (2):

$$BW=(s-1)/(QT*\sqrt{s}) \quad (2)$$

Note that QT is quality factor of the radiating element 9. The QT is determined mainly by the dielectric constant $\epsilon_{reff}$ of the antenna, the configuration of the radiating element 9, and the spacing between the radiating element 9 and conductive ground plate 10. Consequently, when the configuration of the radiating element 9 is determined in advance, the minimum spacing $t_{min}$ between the radiating element 9 and conductive ground plate 10 is defined by the dielectric constant $\epsilon_{reff}$ of the antenna as it is required to obtain a desired operation band and reflection characteristics.

As stated above, the dielectric constant $\epsilon_{reff}$ of the antenna required to obtain a desired beam width, and the minimum interval $t_{min}$ between the radiating element 9 and conductive ground plate 10 required to obtain desired operation band and reflection characteristics are uniquely determined. Accordingly, determination of the thicknesses of the dielectric layers $t_1$–$t_n$ to satisfy the following equations (3) and (4) can obtain the thinnest antenna capable of ensuring desired characteristics.

$$(t_1+t_2+\ldots+t_n)/(t_1/\epsilon_{r1}+t_2/\epsilon_{r2}+\ldots+t_n/\epsilon_{rn})=\epsilon_{reff} \quad (3)$$

$$t_1+t_2+\ldots+t_n=t_{min} \quad (4)$$

Note that $\epsilon_{reff}$ is a dielectric constant of an antenna defined by a desired beam width; $t_{min}$ is the spacing between the radiating element 9 and conductive ground plate 10 capable of ensuring a desired operation band and reflection characteristics in the dielectric constant $\epsilon_{reff}$.

Assuming that a dielectric having desired dielectric constant $\epsilon_{reff}$ and thickness $t_{min}$ exists, the above dielectric layer can be achieved by one layer, However, when a convenient material is not available, a targeted antenna can be constituted by using a combination of a plurality of available dielectrics having different dielectric constants from each other as in embodiment 1.

As described above, according to the embodiment 1, the thinnest antenna apparatus capable of ensuring a desired radiation level in directions of low elevation angles, and desired reflection characteristics and operation band may be provided.

Additionally, as the prior art and the like, in a case where the major radiating conductor of the antenna apparatus is not the feed radiating element, but the no-feed radiating element driven by the feed radiating element, the aforementioned method is applied between the no-feed radiating element and conductive ground plate 10. Similarly, the thinnest antenna apparatus ensuring desired characteristics can be provided.

In addition, of course, some of a plurality of dielectric layers can be constituted by air layers as in the prior art, attained by introducing in the calculation the dielectric constant of the air, and the thickness of the air layers.

Embodiment 2

Figure 2:
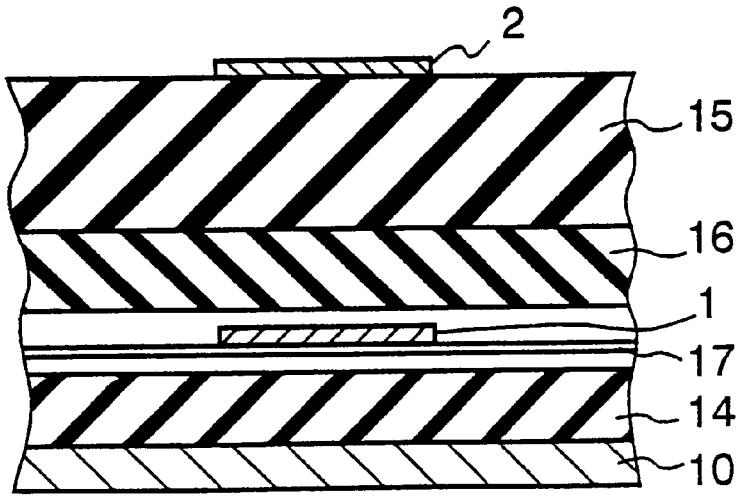
FIG. 2 is a sectional view showing the structure of an antenna apparatus according to Embodiment 2.
Figure 8A:
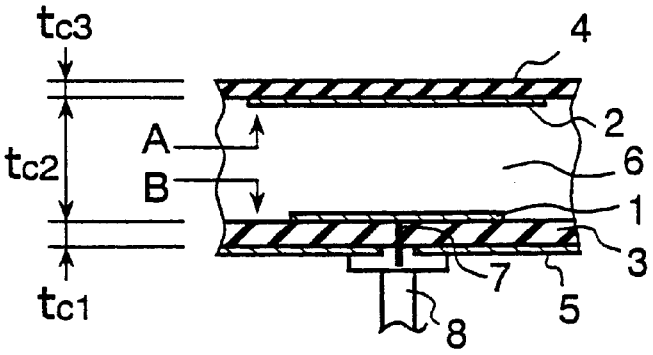
FIGS. 8A, 8B, and 8C are schematic diagrams of constitution of a conventional antenna apparatus.
Figure 8B:
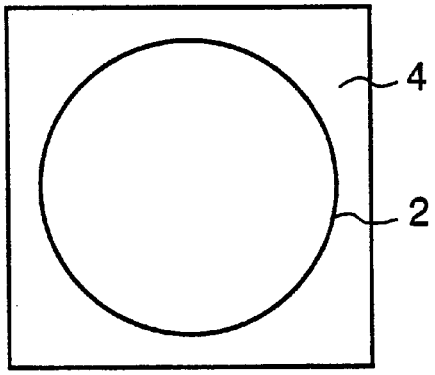
Figure 8C:
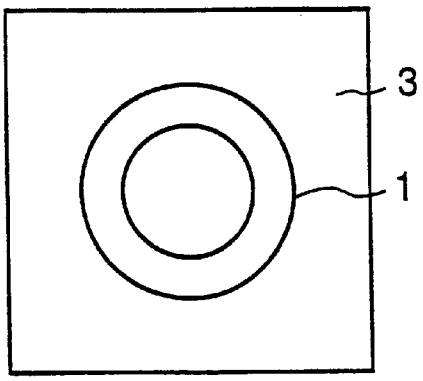

FIG. 2 is a sectional view showing the structure of an antenna apparatus according to embodiment 2 of the present invention. In FIG. 2, numeral 1 designates a feed radiating element of a feed radiating conductor made of copper, aluminum, and the like formed on a film substrate 17 as described hereinafter; numeral 2 designates a no-feed radiating element or conductor which is a major radiating conductor. Numeral 14 designates a first dielectric plate, which is rigid; numeral 15 designates a second dielectric plate, which is rigid, formed of fluorocarbon resin trademarked, Teflon®, by Dupont, PPO (polyphenylene oxide), or the like. Numeral 16 designates a foam material plate made of a foam material such as foam polyethylene, which is a dielectric layer also serving as a buffer material; numeral 17 designates a film substrate formed by etching the feed radiating element 1 and feeding circuit. These layers are closely secured by a method, e.g. screwing, packing, or the like after being stacked. Note that parts similar or corresponding to those denoted in FIGS. 1 and 8A are denoted by the same reference numerals, and redundant explanation thereof will be omitted.

In the antenna apparatus, the dielectric is constituted by the first dielectric plate 14, second dielectric plate 15, and foam material plate 16; the feed radiating element 1 and feeding circuit are constituted on the film substrate 17. Since the film substrate 17 is flexible, the film substrate 17 is pressed against the first dielectric plate 14 to be closely contacted with the foam material plate 16 as a buffer material through the second dielectric plate 15. Thus, it is constituted such that the plane configuration and arrangement precision of the film substrate 17 are maintained. The no-feed radiating element 2 is constituted by adhering the second dielectric plate 15 to a conductor foil, e.g. copper foil tape or the like.

Next, the operation is described.

The operation of the antenna apparatus of the embodiment 2 is similar to that of the prior art: the feed radiating element 1 is driven by radio waves fed through the feeding circuit, and the radio waves radiated from the driven feed radiating element 1 are electromagnetically coupled to the no-feed radiating element 2, thus driving the no-feed radiating element 2. The driven no-feed radiating element 2 radiates spatially the radio waves.

The thicknesses of the first dielectric plate 14, second dielectric plate 15, and foaming material plate 16 are defined by a desired beam width, and desired operation band and reflection characteristics in the same manner as shown in the above embodiment 1. In this case, though the film substrate 17 is ignored because of its thin thickness, the dielectric constant of the film substrate 17 can be introduced in the calculations. The thinnest antenna apparatus that ensures a desired radiating level in directions of low elevation angles, a desired operation band, and low reflection losses can be provided by setting the thickness of such a dielectric layer.

Typically, in the antenna apparatus of the prior art, the embodiment 1, or the like, many of the radiating elements and feeding circuits are constructed by etching a dielectric substrate with a conductive film which is expensive, thus resulting in higher manufacturing cost. On the other hand, the antenna apparatus of the embodiment 2 can control to lower manufacturing cost because of using the film substrate 17.

Further since the film substrate 17 is flexible, it is hard to keep the arrangement precision. However, in the antenna apparatus of the embodiment 2, the film substrate 17 is arranged on the first dielectric plate 14 which is rigid; the foam material plate 16 as a buffer material is arranged on the first dielectric plate 17; the second dielectric plate 15 which is rigid is arranged thereon to press the film substrate 17; accordingly plane configuration and arrangement precision of the feed radiating element 1 in the film substrate 17 can be kept at high precision, thereby ensuring the quality of the antenna apparatus to conduct a desired mode drive at high precision. In addition, lightening of the antenna apparatus is attained by use of the foam material plate 16 with light weight as a dielectric layer.

Embodiment 3

Figure 3:
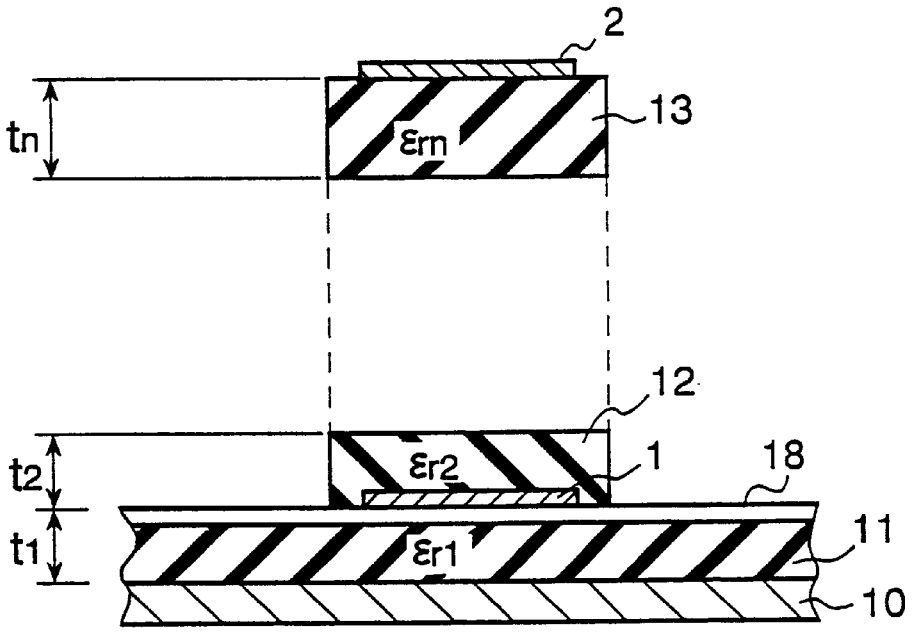
FIG. 3 is a sectional view showing the structure of an antenna apparatus according to Embodiment 3.

FIG. 3 is a sectional view showing the structure of an antenna apparatus according to the embodiment 3 of the present invention. In the drawing, numeral 1 designates a feed radiating element; numeral 2 designates a no-feed radiating element; numeral 18 designates a feeding circuit, formed on a first dielectric layer 11, for feeding the feed radiating element 1. Note that parts similar or corresponding to those denoted in FIG. 1 or 2 are denoted by the same reference numerals, and redundant explanation thereof will be omitted.

As stated in the above embodiment 1, the thicknesses $t_1$–$t_n$ of the dielectric layers are defined by only characteristics which are required for the radiating element. The second to n-th dielectric layers are not required to form the feeding circuit 18; in addition thicknesses of the dielectric layers are concerned only at the perimeters of the feed radiating element 1 and no-feed radiating element 2, while the dielectric layers are not required electrically at the other parts. For this reason, in the embodiment 3, the perimeters of the feed radiating element 1 and no-feed radiating element 2 are left, while the second to n-th dielectric layers are removed.

As described above, according to the embodiment 3, the perimeters of the feed radiating element 1 and no-feed radiating element 2 are left, while the second to n-th dielectric layers are removed; accordingly, lightening can be attained as compared with the above embodiment 1.

Though the no-feed radiating element 2 of which the major radiating conductor is not fed is shown in the above, it is possible to adopt a constitution such that all or part of the dielectric layers are removed by eliminating the perimeter of the major radiating conductor also in case of a radiating conductor in which the major radiating conductor is fed like the above embodiment 1, thus attaining a lighter structure.

Embodiment 4

Figure 4:
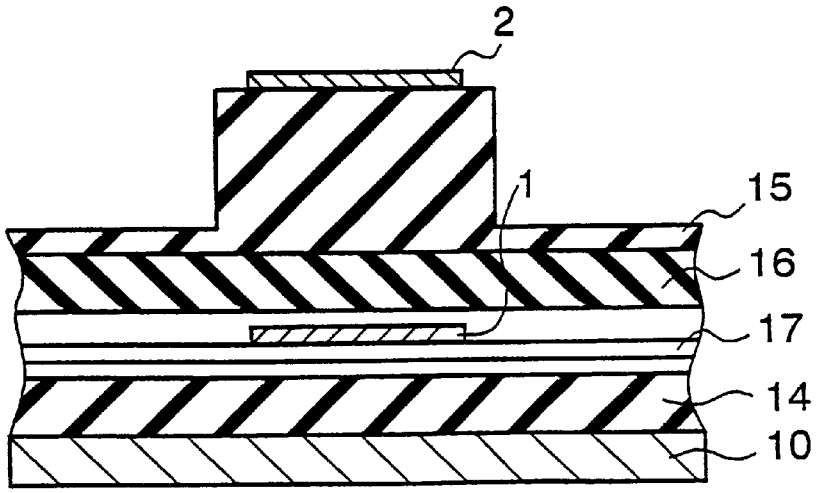
FIG. 4 is a sectional view showing the structure of an antenna apparatus according to Embodiment 4.

FIG. 4 is a sectional view showing the structure of an antenna apparatus according to the embodiment 4 of the present invention. Note that parts similar or corresponding to those denoted in FIG. 2 are denoted by the same reference numerals, and redundant explanation thereof will be omitted. The embodiment 4 forms a thin structure in such a manner that the thickness of the second dielectric plate 15 in the above structure of the embodiment 2 is eliminated at its perimeter.

As stated in the above embodiment 3, the dielectric layers are disposed only at the perimeters of the feed radiating element 1 and no-feed radiating element 2, while the dielectric layers such as the second dielectric plate 15 and foam material plate 16 are not required electrically at the other parts. In the embodiment 4 the second dielectric plate 15 and foaming material plate 16 play a role to press the film substrate 17 from the top to contact closely it with the first dielectric plate 14, thus being not eliminated completely, just keeping the second dielectric plate 15 thinly.

As described above, according to the embodiment 4, the thickness of the second dielectric plate 15 is thinly formed such that the perimeter of the no-feed radiating element 2 is eliminated. Accordingly, the same effects as those of the above embodiment 2 are obtained; also an antenna apparatus with lighter weight as compared with the above embodiment 2 can be achieved.

Embodiment 5

Figure 5:
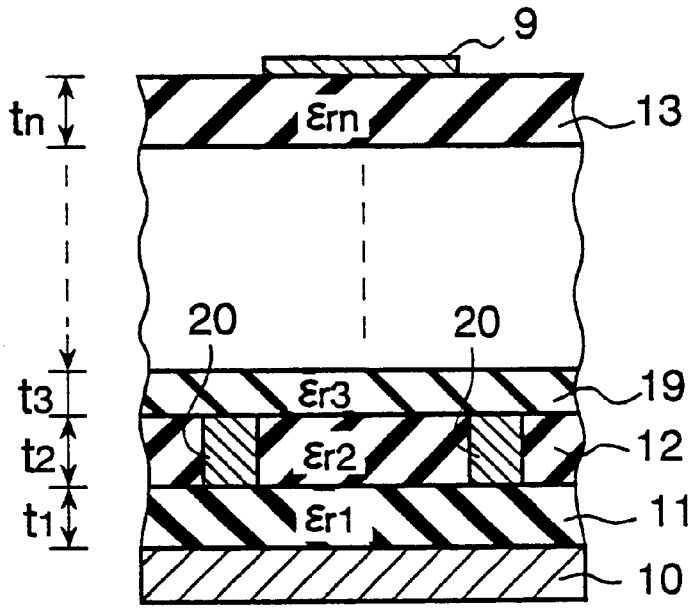
FIG. 5 is a sectional view showing the structure of an antenna apparatus according to Embodiment 5.

FIG. 5 is a sectional view showing the structure of an antenna apparatus according to the embodiment 5. In the drawing, numeral 19 designates a third dielectric layer; numeral 20 designates a spacer (thickness holding structure) provided between the first dielectric layer 11 and the third dielectric layer 19. Note that parts similar or corresponding to those denoted in FIG. 1 are denoted by the same reference numerals, and redundant explanation thereof will be omitted. Here, the first dielectric layer 11 and third dielectric layer 19 is constituted by a material with high rigidity. The second dielectric layer 12 is constituted by a material with low rigidity such as foam material plate. The spacer 20 is made of at least a material with at least a higher rigidity than those of the first and second dielectric layers 11, 12. Disposition of the spacer 20 can employ a method such that the spacer 20 is inserted into a hole or opening formed in the second dielectric layer 12 upon stacking the second dielectric layer 12.

As the second dielectric layer 12 shown in FIG. 5, for the purposes of reducing dielectric losses and pressing flexible members such as film substrate and the like, there is a case that a material with low rigidity as a foam material plate or the like is used. In this case, the dielectric layer with low rigidity, however, causes deformation not to maintain the thickness precision, thereby failing to ensure desired characteristics. For this reason, in the embodiment 5, the spacer 20 is disposed between the first dielectric layer 11 and third dielectric layer 19. In this manner, the thickness precision of the second dielectric layer 12 with low rigidity is maintained.

Additionally, in case of application of a spacer 20 made of a metal, when disposition place of the spacer 20 is near the radiating element 9 to an extent such that a shape of electric field distribution and a resonance frequency of the radiating element 9 change, a material of the spacer 20 had better employ a dielectric instead of metals.

As stated above, according to the embodiment 5, the thickness precision of the second dielectric layer 12 which is constituted by a material with low rigidity such as foam material plate can be maintained. With this manner, when the dielectric layer with low rigidity such as foam material plate is employed, the quality of the antenna apparatus can be maintained.

Embodiment 6

Figure 6:
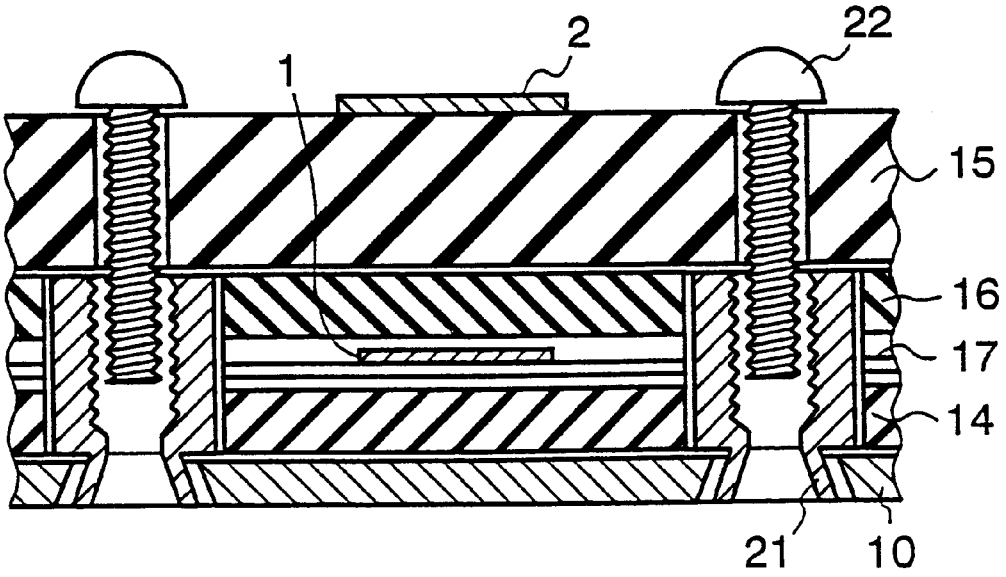
FIG. 6 is a sectional view showing the structure of an antenna apparatus according to Embodiment 6.

FIG. 6 is a sectional view showing a structure of an antenna apparatus according to the embodiment 6. In the drawing, numeral 21 designates a caulking nut; numeral 22 designates a screw meshing with the caulking nut 21; these caulking nut and screw form a thickness holding structure. Note that parts similar or corresponding to those denoted in FIG. 2 are denoted by the same reference numerals, and redundant explanation thereof will be omitted.

In the structure of the above embodiment 2, the embodiment 6 is constituted by disposing the caulking nut 21 in the conductor ground plate 10, contacting the head of the caulking nut 21 with the second dielectric plate 15, and securing the second dielectric plate 15 and caulking nut 21 with a screw 22 through hole or groove provided in the second dielectric plate 15. Additionally, when a metal is employed for the caulked nut 21 and screw 22, when disposition place of the spacer 20 is near the feed radiating element 1 and no-feed radiating element 2 to an extent such that a shape of electric field distribution of and a resonance frequency due to the feed radiating element 1 and no-feed radiating element 2 change, a material of the caulking nut 21 and screw 22 had better employ a dielectric instead of metals.

As described above, according to the embodiment 6, the precision of the interval precision between the conductive ground plate 10 and second dielectric plate 15 can be maintained through the caulked nut 21, and also according to the thickness precision of the first dielectric plate 14, the disposition precision of the film substrate 17 in which the feed radiating element 1 and feeding circuit are formed, and the thickness precision of the foam material plate 16 as a dielectric layer can be maintained, thus keeping the quality of the antenna apparatus.

Embodiment 7

Figure 7A:
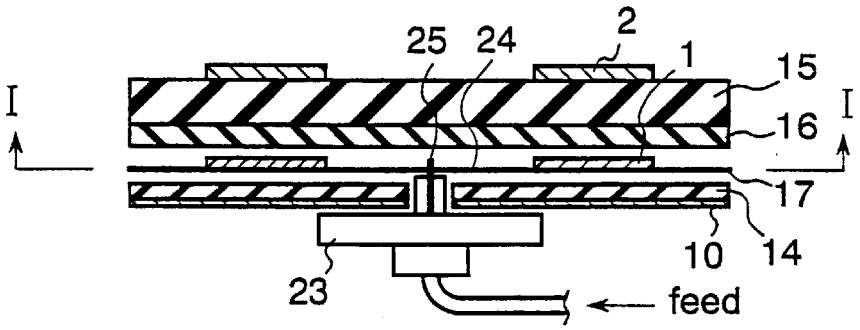
FIGS. 7A, 7B, and 7C are schematic diagrams of constitution of an antenna apparatus according to Embodiment 7.
Figure 7B:
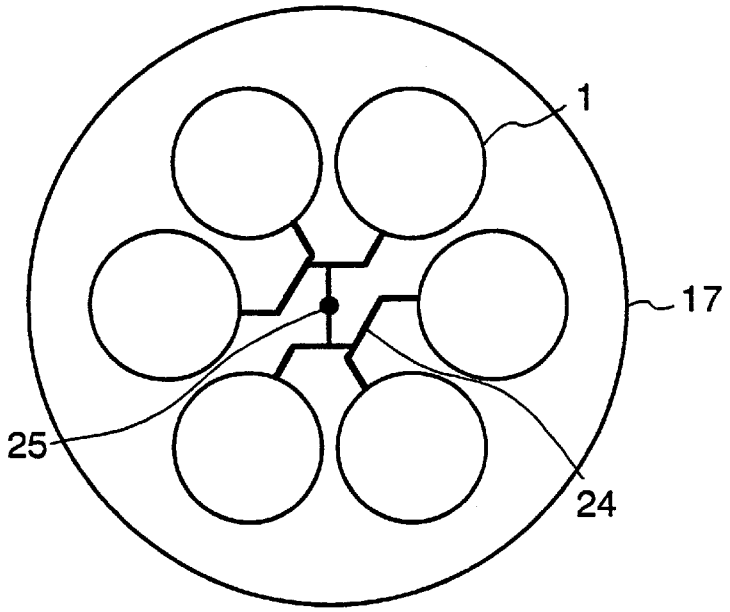
Figure 7C:
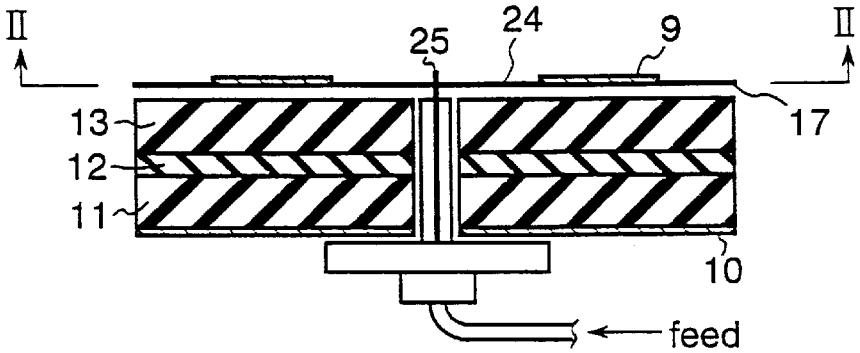

FIGS. 7A–7C are schematic diagrams showing the structure of an antenna apparatus according to the embodiment 7; FIG. 7A is a longitudinal sectional view; FIG. 7B is a sectional view along the line I—I of FIG. 7A. In the drawing, numeral 23 designates a rotary joint; numeral 24 designates a feeding circuit disposed on a film substrate 17; numeral 25 designates a connection of the rotary joint and the feeding circuit 24. The rotary joint 23 is a joint in which the top part in the drawing becomes rotatable to the bottom part in the drawing while keeping the connection. In the embodiment 7, it is constituted such that the top part in the drawing of the rotary joint 23 is secured to the other parts of the antenna apparatus, thus rotating together. Note that parts similar or corresponding to those denoted in FIG. 2 are denoted by the same reference numerals, and redundant explanation thereof will be omitted.

In the embodiment 7, the antenna apparatus of the above embodiment 2 is constituted by an array-antenna, and also fed through the rotary joint 23. A rotating means such as motor for rotating the top part in the drawing is appropriately installed at the rotary joint 23. As shown in FIG. 7B, it is constituted such that the feed radiating element 1 is not disposed on the connection 25 between the rotary joint 23 and feeding circuit 24 so as to conduct effective feeding to the other feed radiating element 1. In this case, a constitution such that the feed radiating element 1 disposed on the center of a feed radiating elements 1 group facilitates a desired radiating pattern relatively. However, selecting an element array such that the feed radiating element 1 is disposed above the connection 25, the feeding circuit 24 and feed radiating element 1 have to be constituted with different layers. The number of the parts increases to boost up the manufacturing cost of the antenna apparatus, thus not adopting such an element array.

As described above, according to the embodiment 7, since the antenna apparatus is rotatable mechanically as a structure with the rotary joint 23, the radiation direction can be rotated freely, thereby forming an antenna apparatus capable of utilizing for automobile mounting of vehicle satellite communication and the like. In addition, it is constituted such that the feed radiating element 1 is not disposed on the connection 25 upon connecting with the rotary joint 23; accordingly, there are no needs that the feeding circuit 24 is arranged with the feed radiating element 1 separately, and that the connection with the feeding circuit 24 is used with a special rotary joint off the rotation center; the manufacturing can be performed at low cost; a rotatable array antenna capable of feeding each feed radiating element 1 effectively may be constituted.

In the above, shown is one example that the rotary joint 23 is applied to an antenna apparatus having the feed radiating element 1 and no-feed radiating element 2, which is a major conductor. The rotary joint 23 also be applied to an antenna apparatus in which a major radiating conductor is a feed radiating conductor. A constitution as shown in FIG. 7C corresponds to this example. The cross section along the line II—II of FIG. 7C is identical to that of FIG. 7B. In the drawing, note that parts similar or corresponding to those in FIGS. 7A and 7B are denoted by the same reference numerals, and redundant explanation thereof will be omitted. Corresponding to said constitution, the rotary joint 23 is connected to the feeding circuit for feeding the major radiating conductor as well, thus obtaining the similar effect.

It will be appreciated from the foregoing description that, according to the first aspect of the present invention, there is provided the antenna apparatus in which n dielectric layers having $t_1$–$t_n$ in thickness, and $\epsilon_{r1}$–$\epsilon_{rn}$ in dielectric constant are respectively stacked between the major radiating conductor and the ground plate in turn from this ground plate side, the thicknesses $t_1$–$t_n$ of the n dielectric layers are determined so as to satisfy substantially the following equation with respect to a dielectric constant $\epsilon_{reff}$ of the antenna defined by a desired beam width:

$$(t_1+t_2+\ldots+t_n)/(t_1/\epsilon_{r1}+t_2/\epsilon_{r2}+\ldots+t_n/\epsilon_{rn})=\epsilon_{reff}$$

and satisfy substantially the following equation with respect to the minimum value $t_{min}$ of the thickness between the radiating conductor and ground plate capable of ensuring desired operation band and low reflection losses in said dielectric constant $\epsilon_{reff}$:

$$t_1+t_2+\ldots+t_n=t_{min}$$

Therefore, there is an effect capable of obtaining the thinnest antenna apparatus which ensures a desired radiation level in directions of low elevation angles, and desired a operation band and low reflection losses.

According to the second aspect of this invention, in the antenna apparatus in which the major radiating conductor is a feed radiating conductor, it is constituted such that the thicknesses $t_1$–$t_n$ of the n dielectric layers are defined as described in the above first aspect. Therefore, there is an effect capable of obtaining the thinnest antenna apparatus which ensures a desired radiation level in directions of low elevation angle, and the desired operation band and low reflection losses.

According to the third aspect of this invention, since the n dielectric layers include an air layer, there is an effect such that the total mass can be reduced.

According to the fourth aspect of this invention, in the antenna apparatus in which the major radiating conductor is a no-feed radiating conductor, it is constituted such that the feed radiating conductor for driving the no-feed major radiating conductor and the feeding circuit for feeding the feed radiating conductor are arranged on a dielectric layer except the n-th layer. Therefore, there is an effect capable of obtaining the thinnest antenna apparatus which ensures a desired radiation level in directions of low elevation angles, and the desired operation band and low reflection losses.

According to the fifth aspect of this invention, it is constituted by arranging a rigid dielectric layer by forming the feed radiating conductor and feeding circuit through the film substrate, arranging the buffer material on the film substrate, and arranging the rigid dielectric layer on the buffer material. Therefore, there are the following effects: the manufacturing cost can be controlled lowly as compared with a case where the feed radiating conductor and feeding circuit are formed by etching the dielectric substrate with a conductive film or the like; also the plane configuration and disposition precision of the feed radiating conductor in the flexible film substrate can be kept at high precision by pressing the rigid dielectric layer through the buffer material; the quality of the antenna apparatus can be ensured so as to drive a desired mode at high precision.

According to the sixth aspect of this invention, since the rigid dielectric layer is made of fluorocarbon resin or polyphenylene oxide, which is easily processed with high rigidity. Therefore, the plane configuration and disposition precision of the feed radiating conductor in the flexible film substrate can be kept at high precision by pressing the rigid dielectric layer through the buffer material, thereby having the above effect.

According to the seventh aspect of this invention, since the buffer material is made of a foam resin, there is an effect that commercial foaming resin can be easily prepared, resulting in lightening the whole apparatus.

According to the eighth aspect of this invention, in the above fifth aspect, it is constituted such that a portion in contact with the buffer material of the rigid dielectric layer is left, and that dielectric layers on the side of the major radiating conductor from said portion are removed except the perimeters of the major radiating conductor and feed radiating conductor. Accordingly, there are effects such that the plane configuration and disposition precision of the feed radiating conductor are secured against pressure to the rigid dielectric layer through the buffer material, thereby ensuring the quality of the antenna apparatus, and that lightening of the antenna apparatus can be attained by elimination of the dielectrics except the portion requiring dielectric thickness.

According to the ninth aspect of this invention, in the above fourth aspect, since all or part of the dielectric layers on the side of the above major radiating conductor are removed from the feed radiating conductor and feeding circuit except the perimeters of the major radiating conductor and feed radiating conductor, there is an effect such that an antenna having lighter weight can be achieved by elimination of the dielectrics except the portion requiring the dielectric thickness.

According to the tenth aspect of this invention, in the above second aspect, since it is constituted such that all or part of the dielectric layers are removed except the perimeters of the major radiating conductor, there is an effect such that an antenna having lighter weight can be achieved by elimination of the dielectrics except the portion requiring the dielectric thickness.

According to the eleventh aspect of this invention, it is constituted such that a thickness holding structure for keeping almost in constant the thickness of the dielectric layer with low rigidity is arranged on any one of the dielectric layers except the n-th layer. Therefore, for the purposes of reducing dielectric losses and pressing flexible members such as film substrate and the like, even in a case that a material with low rigidity such as a foam material plate or the like is used, there is an effect such that the thickness precision of the dielectric layer with low rigidity is maintained, thereby keeping the quality of the antenna apparatus.

According to the twelfth aspect of this invention, since the thickness holding structure is formed by use of the spacer that is intervened between the first dielectric layer and the third dielectric layer which are higher in rigidity than the second dielectric layer with low rigidity, and that is contained in the second dielectric layer, there is an effect such that the thickness precision of the dielectric layer with low rigidity is maintained, thereby keeping the quality of the antenna apparatus as described above.

According to the thirteenth aspect of this invention, since the spacer is made of a material having a rigidity higher than that of the second dielectric layer, there is an effect such that the thickness precision of the dielectric layer with low rigidity is maintained, thereby keeping the quality of the antenna apparatus as described above.

According to the fourteenth aspect of this invention, since the spacer is constituted in such a manner that the caulking nut is intervened between the first and second dielectric layers, and that the ground plate meshes with the screw via the opening through the third dielectric layer from its top, there is an effect such that cooperation between the caulking nut and screw can enhance further the capability of keeping the thickness precision by means of the spacer.

According to the fifteenth aspect of this invention, since it is constituted such that the rotary joint is connected with the feeding circuit so as to feed the major radiating conductor, and that said major radiating conductor is arranged to prevent the feeding circuit and the connection with the rotary joint from overlapping, the antenna apparatus can be pivoted mechanically to pivot freely its radiation direction. Therefore, there is an effect such that an antenna apparatus applicable to automobile mounting of vehicle satellite communication and the like can be achieved.

According to the sixteenth aspect of this invention, since the rotary joint is connected to the feeding circuit for feeding the feed radiating conductor, and that the feed radiating conductor is arranged to prevent the feeding circuit and the rotary joint from overlapping at the connection, the antenna apparatus can be pivoted mechanically to pivot freely its radiation direction as described above. Therefore, there is an effect such that an antenna apparatus applicable to automobile mounting for vehicle satellite communications and the like can be achieved.

What is claimed is:

1. An antenna apparatus in which n dielectric layers having $t_1$–$t_n$ in thickness, and $\epsilon_{r1}$–$\epsilon_{rn}$ in dielectric constant are respectively stacked between a major radiating conductor and a ground plate in turn from the side of said ground plate, said antenna apparatus defining the thicknesses $t_1$–$t_n$ of said n dielectric layers so as to satisfy substantially the following equation with respect to a dielectric constant $\epsilon_{reff}$ of an antenna defined by a desired beam width:

$$(t_1+t_2+\ldots+t_n)/(t_1/\epsilon_{r1}+t_2/\epsilon_{r2}+\ldots+t_n/\epsilon_{rn})=\epsilon_{reff}$$

and satisfy substantially the following equation with respect to the minimum value $t_{min}$ of a thickness between the major radiating conductor and ground plate capable of ensuring desired operation band and low reflection losses in said dielectric constant $\epsilon_{reff}$:

$$t_1+t_2+\ldots+t_n=t_{min};$$

wherein a thickness holding structure is provided on any one of the dielectric layers except the n-th layer for keeping the thickness of the dielectric layer substantially constant with low rigidity.

2. An antenna apparatus as set forth in claim 1, wherein said major radiating conductor is a feed radiating conductor which is fed.

3. An antenna apparatus as set forth in claim 1, wherein the n-th dielectric layer includes an air layer.

4. An antenna apparatus as set forth in claim 1, comprising:

a major radiating conductor formed on the n-th dielectric layer which is not fed;

a feed radiating conductor, formed on a dielectric layer except the n-th layer, for driving said major radiating conductor; and a feeding circuit for feeding said feed radiating conductor.

5. An antenna apparatus in which n dielectric layers having $t_1$–$t_n$ in thickness, and $\epsilon_{r1}$–$\epsilon_{rn}$ in dielectric constant are respectively stacked between a major radiating conductor and a ground plate in turn from the side of said ground plate, said antenna apparatus defining the thicknesses $t_1$–$t_n$ of said n dielectric layers so as to satisfy substantially the following equation with respect to a dielectric constant $\epsilon_{reff}$ of an antenna defined by a desired beam width:

$$(t_1+t_2+\ldots+t_n)/(t_1/\epsilon_{r1}+t_2/\epsilon_{r2}+\ldots+t_n/\epsilon_{rn})=\epsilon_{reff}$$

and satisfy substantially the following equation with respect to the minimum value $t_{min}$ of a thickness between the major radiating conductor and ground plate capable of ensuring desired operation band and low reflection losses in said dielectric constant $\epsilon_{reff}$:

$$t_1+t_2+\ldots+t_n=t_{min};$$

said antenna apparatus further comprising:

a major radiating conductor formed on the n-th dielectric layer which is not fed;

a feed radiating conductor, formed on a dielectric layer except the n-th layer, for driving said major radiating conductor; and a feeding circuit for feeding said feed radiating conductor; wherein the feed radiating conductor and feeding circuit are formed by use of a film substrate disposed on a rigid dielectric layer; a buffer material is disposed on said film substrate; and a rigid dielectric layer is disposed on said buffer material.

6. An antenna apparatus as set forth in claim 5, wherein the rigid dielectric layer is made of fluorocarbon resin or polyphenylene oxide.

7. An antenna apparatus as set forth in claim 5, wherein the buffer material is made of foam resin.

8. An antenna apparatus as set forth in claim 5, wherein a portion in contact with the buffer material of the rigid dielectric layer is left; the dielectric layer on the side of the major radiating conductor from said portion is removed except the perimeters of the major radiating conductor and feed radiating conductor.

9. An antenna apparatus in which n dielectric layers having $t_1$–$t_n$ in thickness, and $\epsilon_{r1}$–$\epsilon_{rn}$ in dielectric constant are respectively stacked between a major radiating conductor and a ground plate in turn from the side of said ground plate, said antenna apparatus defining the thicknesses $t_1$–$t_n$ of said n dielectric layers so as to satisfy substantially the following equation with respect to a dielectric constant $\epsilon_{reff}$ of an antenna defined by a desired beam width:

$$(t_1+t_2+\ldots+t_n)/(t_1/\epsilon_{r1}+t_2/\epsilon_{r2}+\ldots+t_n/\epsilon_{rn})=\epsilon_{reff}$$

and satisfy substantially the following equation with respect to the minimum value $t_{min}$ of a thickness between the major radiating conductor and ground plate capable of ensuring desired operation band and low reflection losses in said dielectric constant $\epsilon_{reff}$:

$$t_1+t_2+\ldots+t_n=t_{min};$$

said antenna apparatus further comprising:

a major radiating conductor formed on the n-th dielectric layer which is not fed;

a feed radiating conductor, formed on a dielectric layer except the n-th layer, for driving said major radiating conductor; and a feeding circuit for feeding said feed radiating conductor; wherein all of part of the dielectric layers on the side of said major radiating conductor from the feed radiating conductor and feeding circuit are removed except at the perimeters of the major radiating conductor and feed radiating conductor.

10. An antenna apparatus as set forth in claim 9, wherein all or part of the dielectric layers are removed except at the perimeter of the major radiating conductor.

11. An antenna apparatus as set forth in claim 1, wherein the thickness holding structure is formed by use of a spacer that is intervened between a first dielectric layer and a third dielectric layer which are higher in rigidity than a second dielectric layer with low rigidity, and that is contained in the second dielectric layer.

12. An antenna apparatus as set forth in claim 11, wherein the spacer has a rigidity higher than that of the second dielectric layer.

13. An antenna apparatus as set forth in claim 11, wherein the spacer is constructed in such a manner that a caulking nut which is intervened between the first and second dielectric layers and engages a ground plate meshes with a screw via an opening through the third dielectric layer from its top.

14. An antenna apparatus as set forth in claim 1 wherein a rotary joint is connected to a feeding circuit for feeding the major radiating conductor, and the major radiating conductor is arranged to prevent the feeding circuit and said rotary joint from overlapping at the connection.

15. An antenna apparatus as set forth in claim 3, wherein a rotary joint is connected to a feeding circuit for feeding the feed radiating conductor, and the feed radiating conductor is arranged to prevent the feeding circuit and said rotary joint from overlapping at the connection.

* * * * *